US007617758B2

(12) United States Patent
Gavage et al.

(10) Patent No.: US 7,617,758 B2
(45) Date of Patent: Nov. 17, 2009

(54) FIRING DEVICE

(75) Inventors: Xavier Robert Paul Gavage, Chaudfontaine (BE); Philippe Désiré Odiel Reinaers, Bilstain (BE); Alain Albert Anne Vincent Malpas, Dalhem (BE)

(73) Assignee: FN Herstal. Societe Anonyme, Herstal (BE)

( * ) Notice: Subject to any disclaimer, the term of this patent is extended or adjusted under 35 U.S.C. 154(b) by 676 days.

(21) Appl. No.: 11/254,714

(22) Filed: Oct. 21, 2005

(65) Prior Publication Data

US 2006/0207463 A1 Sep. 21, 2006

(30) Foreign Application Priority Data

Oct. 25, 2004 (BE) ..... 2004/0521

(51) Int. Cl.
*F41A 5/16* (2006.01)

(52) U.S. Cl. ..... 89/161; 89/1.7; 42/50

(58) Field of Classification Search ..... 89/160, 89/161.1, 702, 137, 1.7, 1.706, 159, 161; 42/10, 11

See application file for complete search history.

(56) References Cited

U.S. PATENT DOCUMENTS 3,538,635 A * 11/1970 Friend ..... 42/10
3,554,425 A * 1/1971 Oesterle ..... 227/10
4,019,424 A 4/1977 Reynolds
4,028,994 A * 6/1977 Ferluga ..... 89/161
4,061,075 A * 12/1977 Smith ..... 89/132
5,123,329 A 6/1992 Irwin
5,939,659 A * 8/1999 Dobbins ..... 89/161
6,405,631 B1 * 6/2002 Milek ..... 89/139
6,964,220 B1 * 11/2005 Lavin ..... 89/159
7,231,864 B2 * 6/2007 Ratti ..... 89/161

FOREIGN PATENT DOCUMENTS

DE 105563 10/1899
DE 402477 9/1924

* cited by examiner

*Primary Examiner*—Michael Carone
*Assistant Examiner*—Benjamin P Lee
(74) *Attorney, Agent, or Firm*—Bacon & Thomas, PLLC

(57) ABSTRACT

Firing device includes a firearm which includes a cartridge carrier in the loader in front of the entry of the barrel and supported against a supporting element of the casing which includes the firing mechanism and whereby the barrel slides in the casing into a position in which the barrel comes to a stop through the action of a return spring against the front part of the case of the cartridges and wherein each cartridge is provided with propulsion arrangement to project the case and the barrel forward.

22 Claims, 12 Drawing Sheets

FIRING DEVICE

BACKGROUND OF THE INVENTION

A. Field

The invention concerns a firing device consisting of a firearm and its ammunition.

B. Related Art

In particular, the invention concerns a semi-automatic firearm and its ammunition, designed to launch a projectile with reduced lethality, which projectile has to be propelled at low pressure so as not to break.

As pyrotechnical propulsion systems require a high-pressure combustion in order to provide for a regular ballistic cycle, said projectile, due to its fragility, cannot be fired directly as with conventional small caliber ammunition.

Usually, a firearm comprises a barrel with a chamber, an extraction, ejection and feed mechanism.

The present invention presents a firing device comprising a firearm with a barrel which has neither a chamber, nor an extraction or ejection mechanism, as no extraction is required and the ejection is provided for by the ammunition present in the loader.

Usually, in a semi-automatic firearm, the ammunition leaves the loader and is supplied in the arm.

Within the scope of the present invention, the ammunition does not leave the loader during the supply phase, and there is no supply cycle as such.

BRIEF SUMMARY OF THE INVENTION

To this end, the invention presents a firing device comprising a firearm and its ammunition, wherein the firearm comprises a casing, a barrel, a loader, a firing mechanism and the ammunition, comprising one or several cartridges, each in the form of a case with a projectile and a propulsive charge, wherein the device further comprises means to carry a cartridge into the loader opposite the entry of the barrel and a support against a supporting element of the casing which comprises the firing mechanism, and wherein the barrel slides in the casing between at least a forward position for the positioning and ejection of a cartridge and a recoiled firing position in which the barrel comes to a stop through the action of a release spring against the front part of the case of the cartridge which is situated opposite the entry of the barrel, and wherein each cartridge is provided with propulsion means to project, after having activated the firing mechanism, the case and the barrel forward so as to put the barrel into its forward position, and wherein the case of the ammunition is provided with external protuberances which make it possible to active a part of the firing mechanism of the firearm.

With a firing device according to the invention, the case of the cartridge so to say forms an extension of the barrel of the firearm and thus performs the function of the chamber of the barrel in a conventional arm, as well as a part of the barrel.

In this manner the cartridge need not be supplied in the barrel and extracted from the barrel after the shooting.

Thus, a supply and extraction mechanism as in the known arms is no longer required.

The ammunition is realized in such a manner that it withstands the pressures resulting from the firing of the propulsive charge.

The invention also concerns a firearm and the ammunition which can be used in a firing device according to the invention.

DESCRIPTION OF THE DRAWINGS

For clarity's sake, an example of an embodiment of a firing device according to the invention, comprising a firearm and its ammunition, is described hereafter as an example only without being limitative in any way, with reference to the accompanying drawings, in which.

DETAILED DESCRIPTION OF PREFERRED

Embodiments of the Invention

Figure 1:
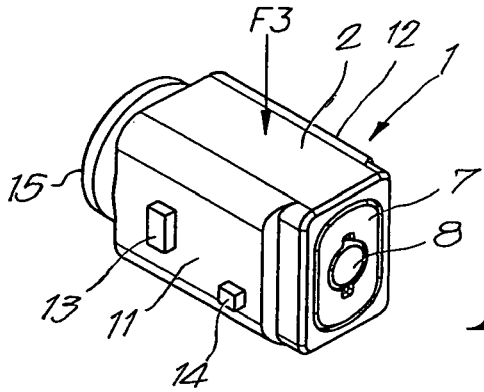
FIG. 1 is a view in perspective of a cartridge of the ammunition according to the invention.
Figure 2:
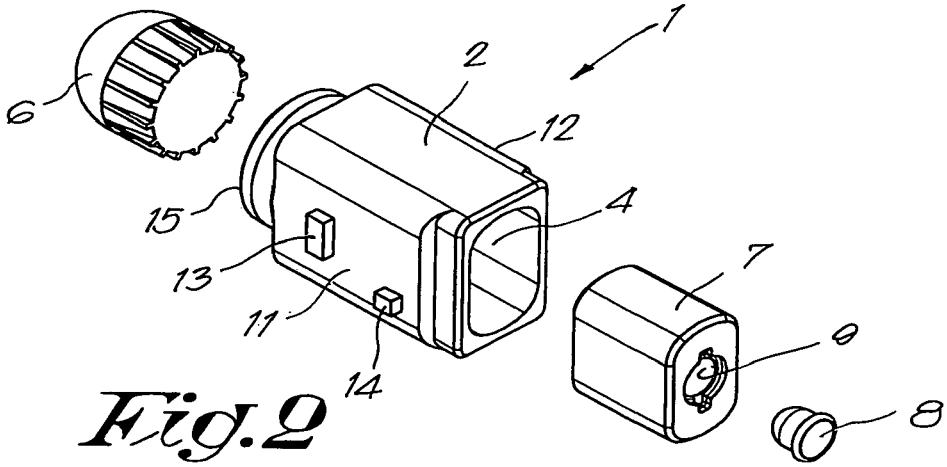
FIG. 2 is an exploded view of the cartridge from FIG. 1.
Figure 3:
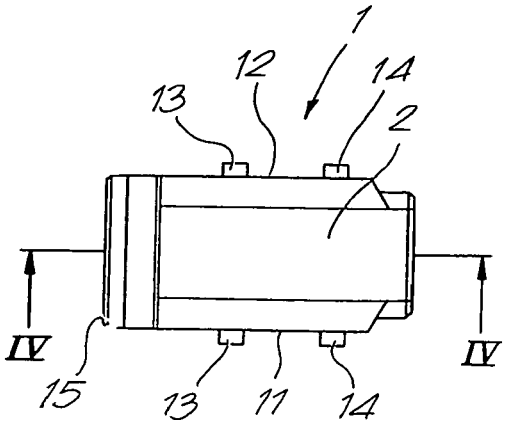
FIG. 3 is a view according to arrow F3 in FIG. 1.
Figure 4:
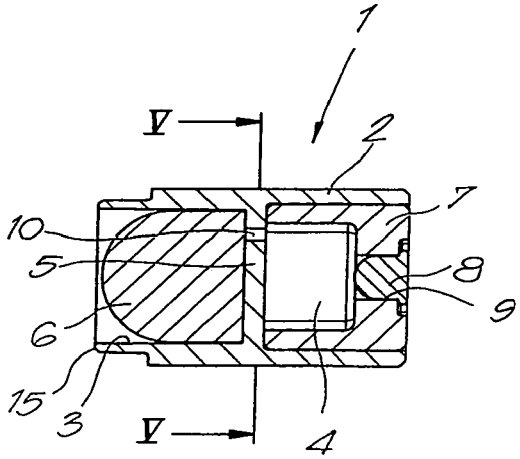
FIG. 4 is a section according to line IV-IV in FIG. 3.
Figure 5:
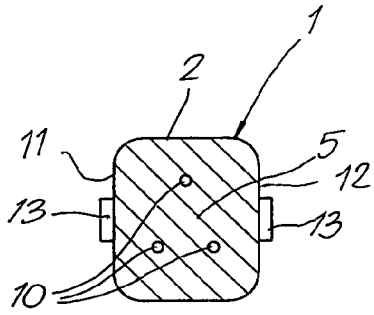
FIG. 5 is a section according to line V-V in FIG. 4.

FIGS. 1 to 6 represent a cartridge 1 of the ammunition of the firing device according to the invention.

This cartridge 1 is formed of a case 2 which contains two chambers 3 and 4 which are separated by means of a partition wall 5.

The chamber 3 in front of the cartridge 1, the so-called low-pressure chamber, is a cylindrical chamber which is open in the front and which houses a projectile 6 which is held in said chamber against the partition wall 5.

For clarity's sake, the terms in front of/opposite and behind are defined in relation to the user of a firearm aiming at a target in front of him.

Chamber 4 in the rear part of the cartridge 1, the so-called high-pressure chamber, comprises projection means of the case 2 which consist of a piston 7 which fits in said chamber, whereby said piston 7 can slide in the longitudinal sense of the case 2 and is provided with a propulsive charge 8 held in a longitudinal passage 9 which crosses the piston 7.

The two chambers 3 and 4 are mutually connected by means of a single vent hole or a series of vent holes.

In order to launch the projectile 6 at a regular speed, the propulsive charge is contained within a blanc cartridge with an annular percussion or a central percussion (or, alternatively, a detonator possibly provided with an additional filling).

The cartridge is realized (i.e., formed or made) in such a manner that it withstands the maximum pressure in the high-pressure chamber 4 which results from the ignition of the propulsive charge 8 when firing, which makes it possible to realize a firearm whose barrel has no chamber.

In order to realize the ammunition in an economical manner, the case 2 and the piston 7 are made of plastic.

In order to protect the projectile 6 against external shocks, the latter is preferably placed entirely inside the low-pressure chamber 3.

The edge of the front part 15 of the case 2 is beveled such that said part is slightly conical.

The case 2 of the cartridge 1 comprises two sides 11 and 12 provided with external protuberances called front pins 13 and rear pins 14, designed to keep the case within the arm and to activate a part of the mechanism of the firearm.

Figure 6:
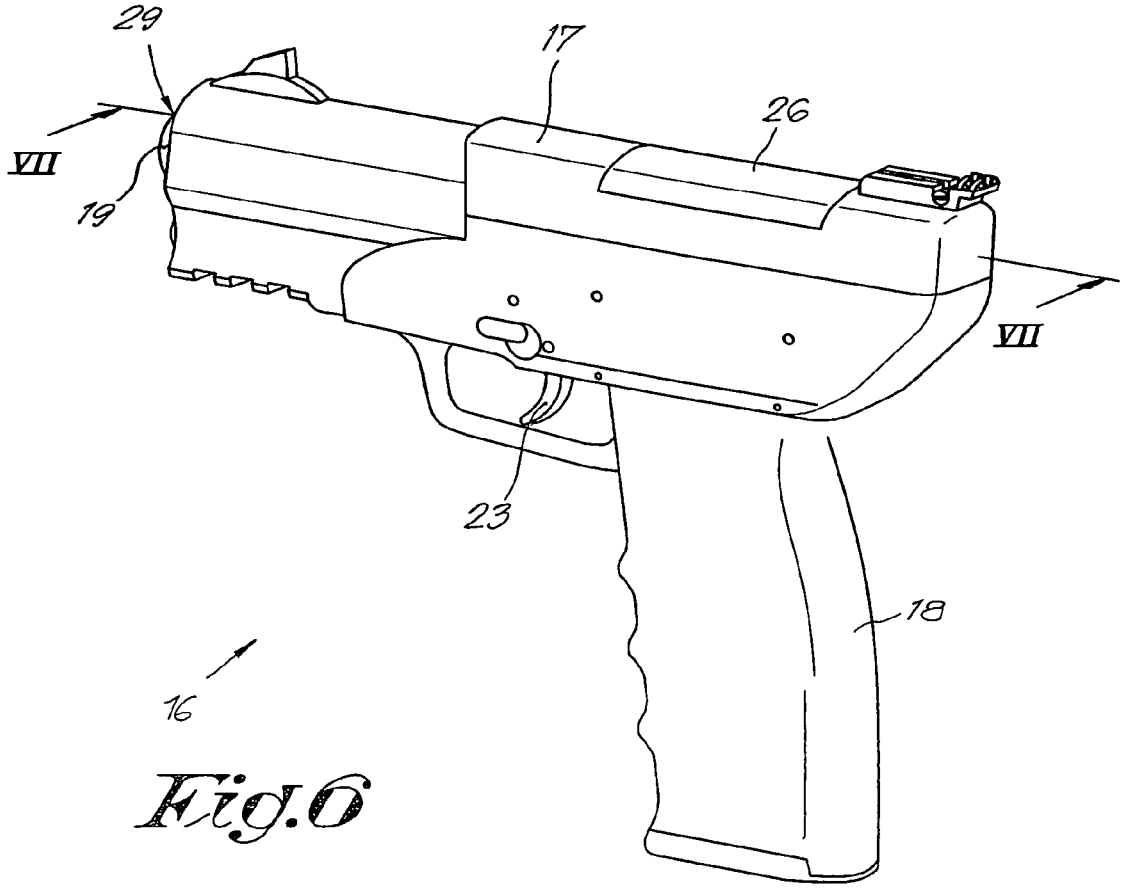
FIG. 6 is a view in perspective of a firearm according to the invention.
Figure 7:
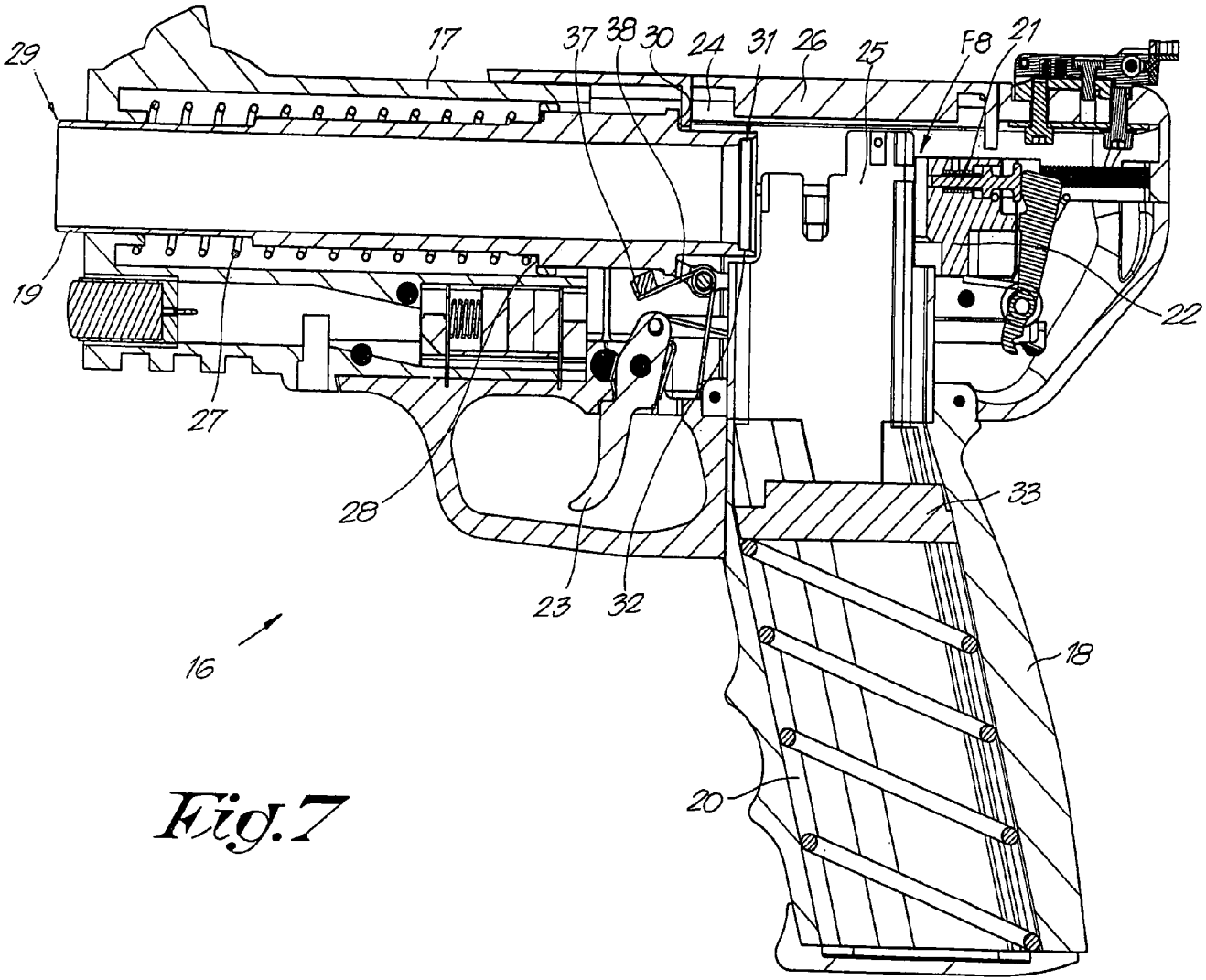
FIG. 7 is a section according to line VII-VII of FIG. 6.
Figure 8:
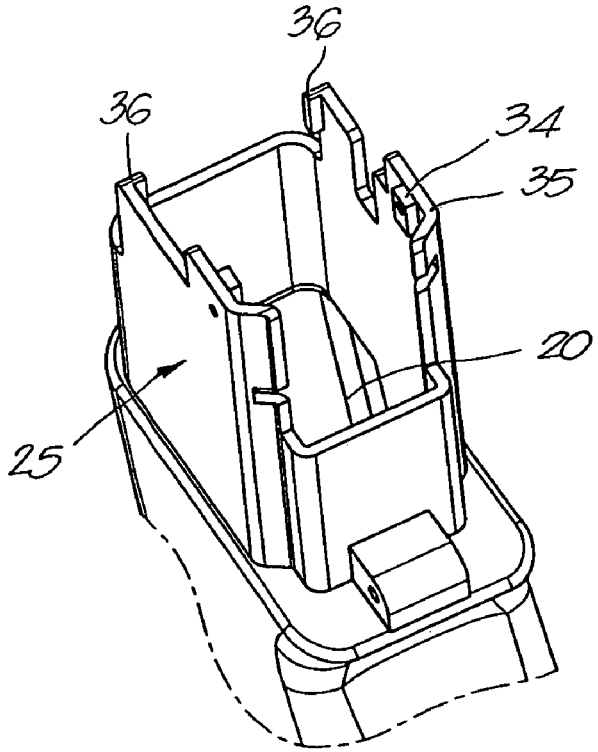
FIG. 8 is a view in perspective of the part of the loader indicated by FE in FIG. 7, to a larger scale.
Figure 9:
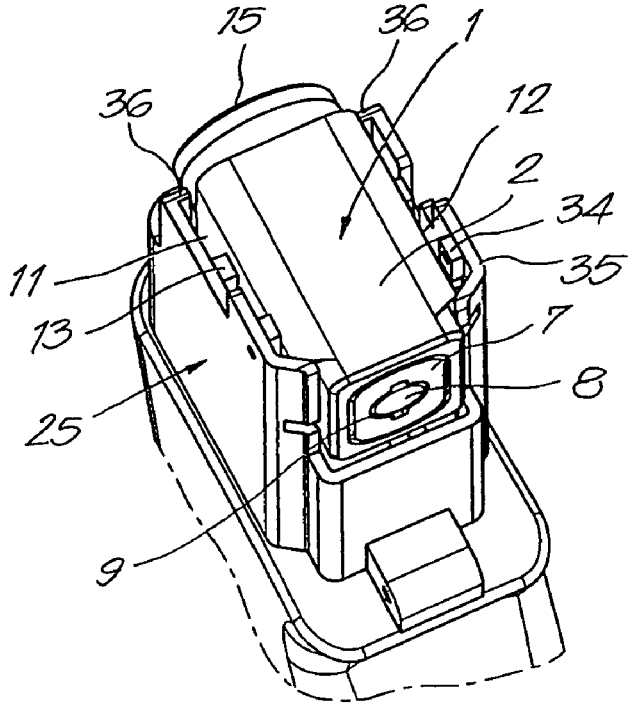
FIG. 9 is a similar view to that of FIG. 8, but with a cartridge in the loader.

FIGS. 6 and 7 represent a firearm 16 according to the invention, whereby said firearm 16 comprises a casing 17 with a grip 19, a barrel 19, a loader 20 situated in the grip 18, a firing mechanism 21 which is situated in a support element 22 for the ammunition which is part of the casing 17 and which is controlled by a trigger 23, and an ejection window 24 for the ammunition which is placed in the extension and in front of the exit 25 of the loader 20, and which is covered with a pivoting flap 26 which simultaneously serves as a lateral deviation device for the ejected ammunition.

The barrel 19 is mounted in the casing 17 in a sliding manner in the axial direction of the barrel 19.

A release spring 27 is mounted between the front end of the casing 17 and a shoulder 28 of the barrel 19 situated at a distance from the muzzle 29 of the barrel 19.

The rear part of the barrel 19 is provided with a second shoulder 30 situated at a distance from the entry 31 of the barrel 19.

The entry 31 of the barrel 19 is provided with a concentric ring 32 having an inner diameter which is equal to or slightly larger than the outer diameter of the front part 15 of a case 2 of a cartridge 1 as described.

Said ring is slightly beveled so as to obtain a concentric entry.

The inner diameter of the barrel 18 is equal to or slightly larger than the inner diameter of the low-pressure chamber of a cartridge 1.

In the given example, the loader 20 of the firearm 16 is integrated in the grip 18, although it is not excluded to provide a separate loader 20.

The loader 20 is provided with means to carry a cartridge into the loader 20 in front of the entry 31 of the barrel 19 and supported against a supporting element 22 of the casing 17, whereby these means are formed of a feeder 33 which pushes the ammunition towards the exit 25 of the loader 20 on the one hand, and of one or two stops 34 mounted at the exit of the loader 20 on the other hand, more particularly on the inner sides of two extended side flanks 35 of the loader 20, whereby these stops 34 can work in conjunction with (i.e., cooperate with) the rear pins 14 of the cartridges 1.

The stops 34 are placed such that a cartridge 1 which is brought in front of the barrel 19 is aligned with the latter, and in such a manner that the propulsive charge is situated in front of the firing mechanism 21.

The side flanks 35 are provided with two additional stops 36 in the front.

The firearm 16 is provided with peg to lock the barrel 19 in a forward position, whereby said peg is realized in the shape of a tilting lever 37 which is provided with a release spring 38 and whose first far end can work in conjunction with the shoulder 30 of the barrel 19.

The other far end 40 of the tilting lever 37 can work in conjunction with an unlocking mechanism, controlled by the movement of a new cartridge when it is placed in front of the entry 31 of the barrel 19.

This locking mechanism is realized for example by means of a push rod 41 which can slide in the casing 17 in the direction of transport of the ammunition in the loader 20, whereby the push rod is provided with a groove 42 which holds the second far end 40 of the tilting lever 37 of the peg which is provided with a cam 43 which can work in conjunction with a front pin 13.

The use and working of the firing device is simple and is illustrated as follows by means of the drawings 10 to 19.

Figure 10:
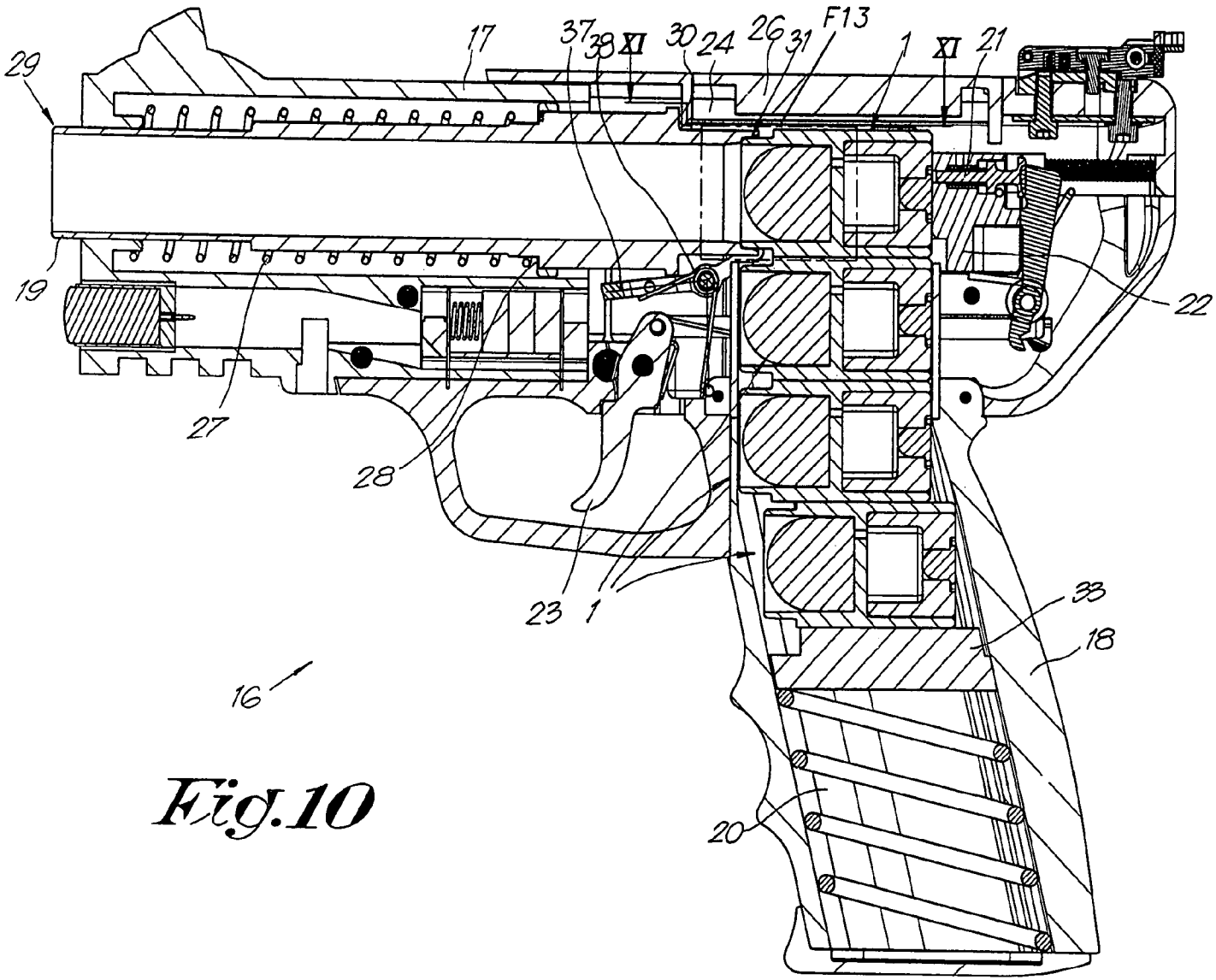
FIG. 10 is a section similar to that of FIG. 7, but with the ammunition present in the firearm.
Figure 11:
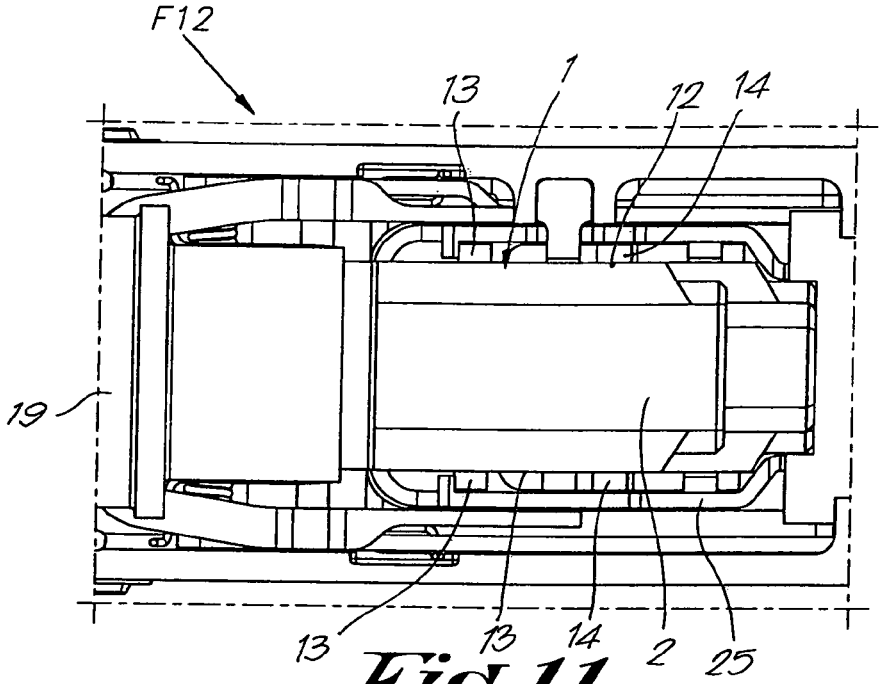
FIG. 11 is a section according to line XI-XI in FIG. 10.

FIG. 10 shows a firearm 16 comprising a few cartridges 1 in the loader 20, one cartridge 1 of which is ready to be fired and which is held between the supporting element 22 and the entry 31 of the barrel 19, whereby the piston 7 is supported against said element 22 with the propulsive charge situated opposite the firing mechanism 21.

In this situation, the barrel 19 is situated in a recoiled firing position in which the barrel 19 comes to a stop against the front part 15 of the case 2 of the cartridge 1 through the action of the release spring 27.

Figure 12:
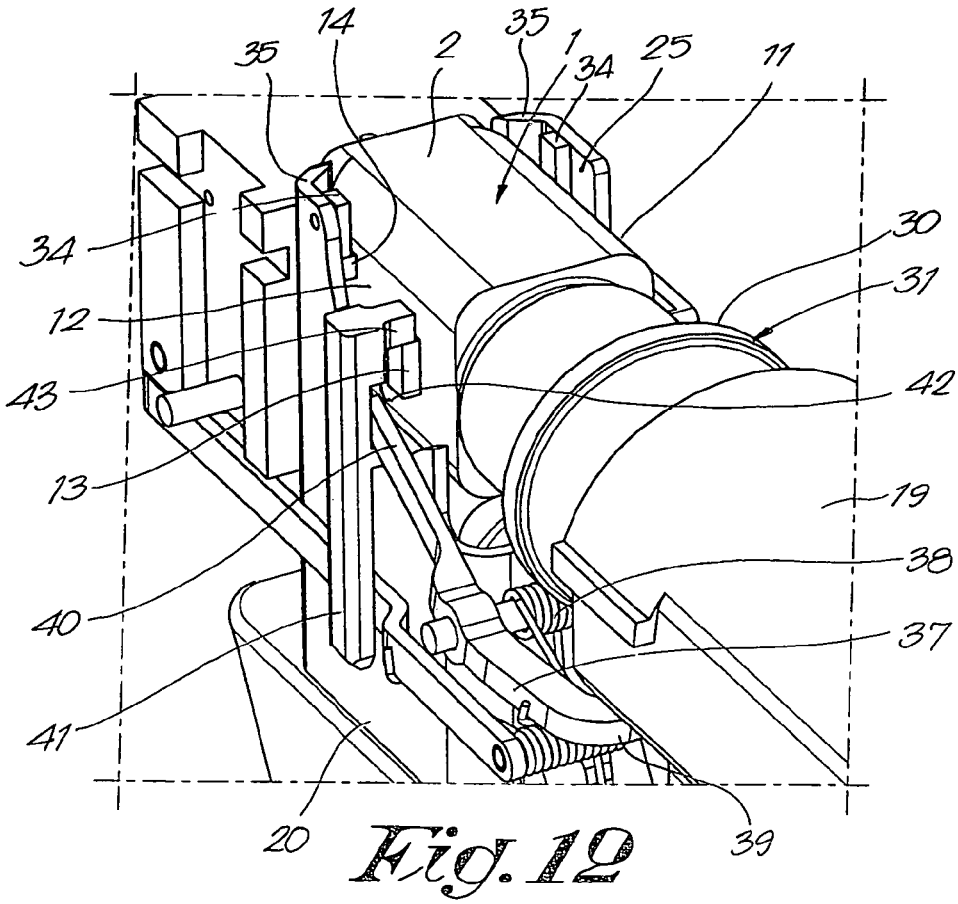
FIG. 12 is a view in perspective according to arrow F12 in FIG. 11.

As is indicated in greater detail in FIG. 12, the front pin 13 makes the push rod 41 rise, which makes the lever 37 tilt so as to remove the far end 39 from the barrel 19.

Figure 13:
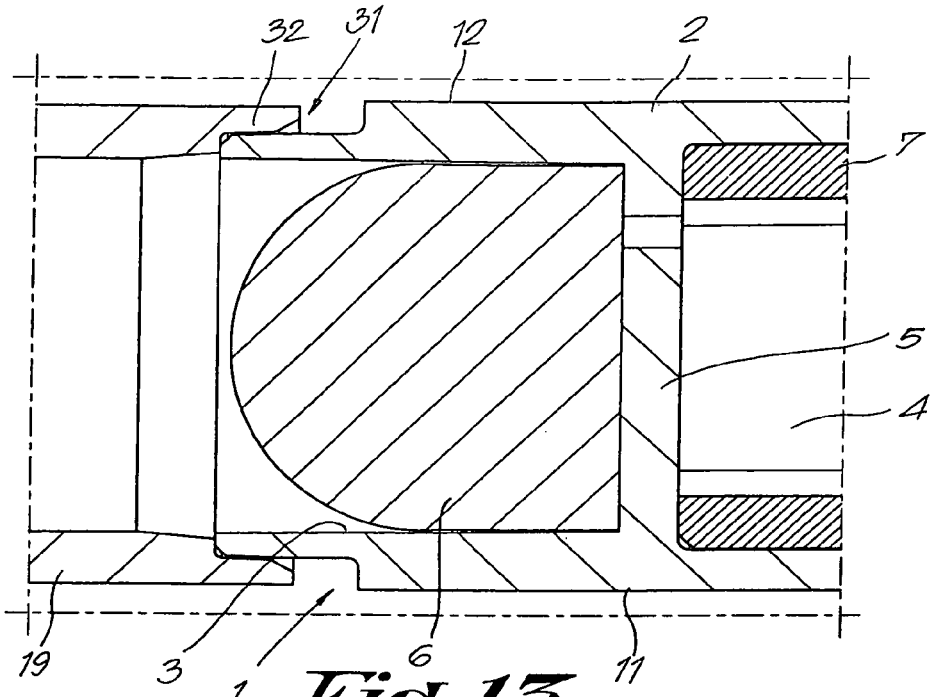
FIG. 13 represents the part indicated by F13 in FIG. 10 to a larger scale.

FIG. 13 shows how, in this situation, the front part of the case 2 is encased in the ring 32 of the entry 31 of the barrel 19 and is centered in this ring 32.

When the firing mechanism 21 is activated to fire by the trigger 23, the propulsive charge 8 fuses and gases under pressure will fill the high-pressure chamber 4.

Figure 14:
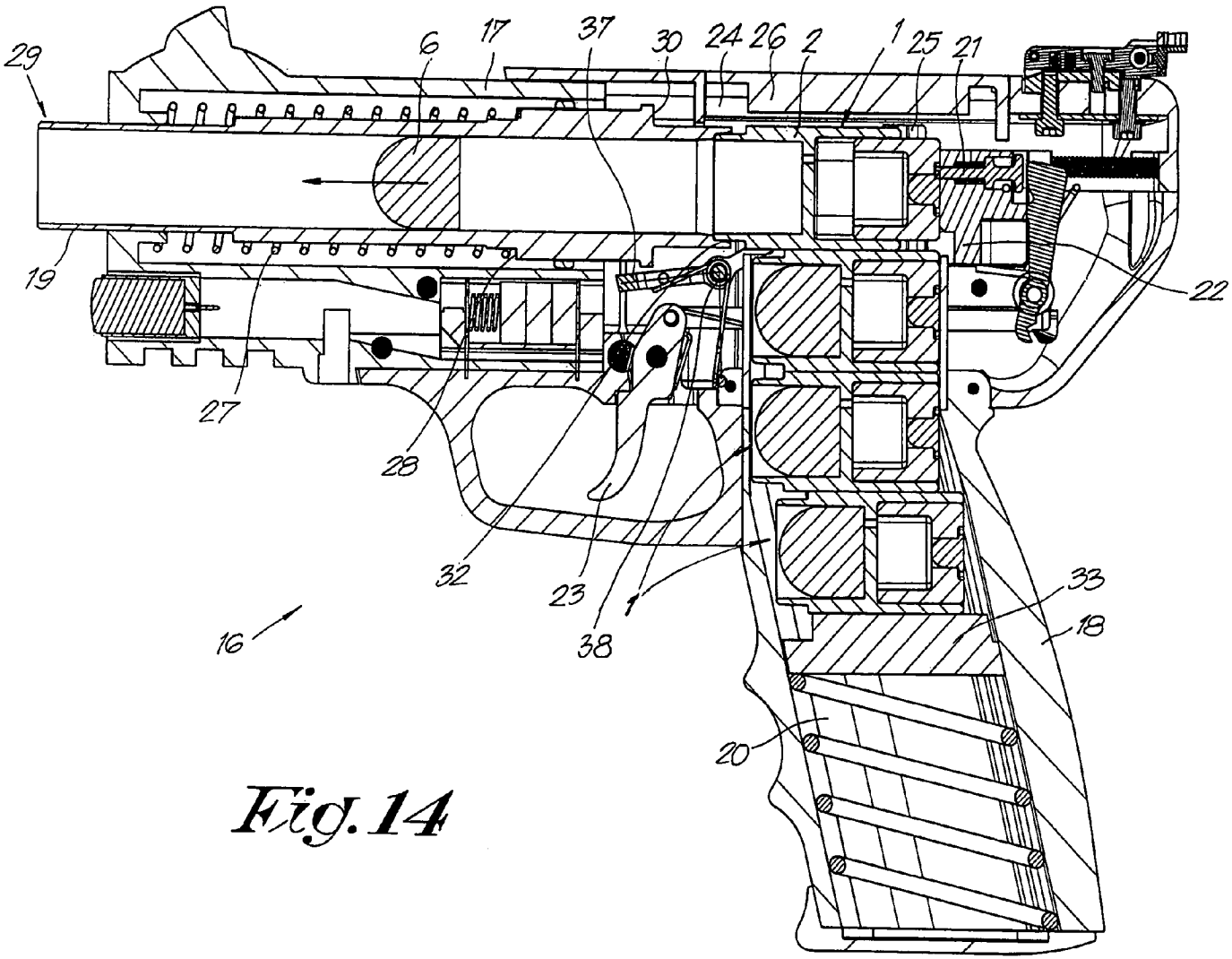
FIG. 14 is a section similar to that in FIG. 10, but when a shot is being fired.

As a result, since the piston 7 is being supported, the case 2 is launched forward and carries along the barrel 19 in its movement, as represented in FIG. 14.

The high-pressure gases can escape through the vent holes 10 towards the low-pressure chamber 3, so as to propel the projectile 6 via the barrel 19 as in FIG. 14.

The tightness between the barrel 19 and the case 2 is obtained among others by covering the barrel 19 and the front part 15 of the case 2 and thanks to the fact that said front part 15 is made of plastic material which is pushed against the barrel 19, whereby the inertia of the barrel 19 makes it possible to create a major contact pressure between the front part 15 and the barrel 19, thus creating the required tightness.

Figure 16:
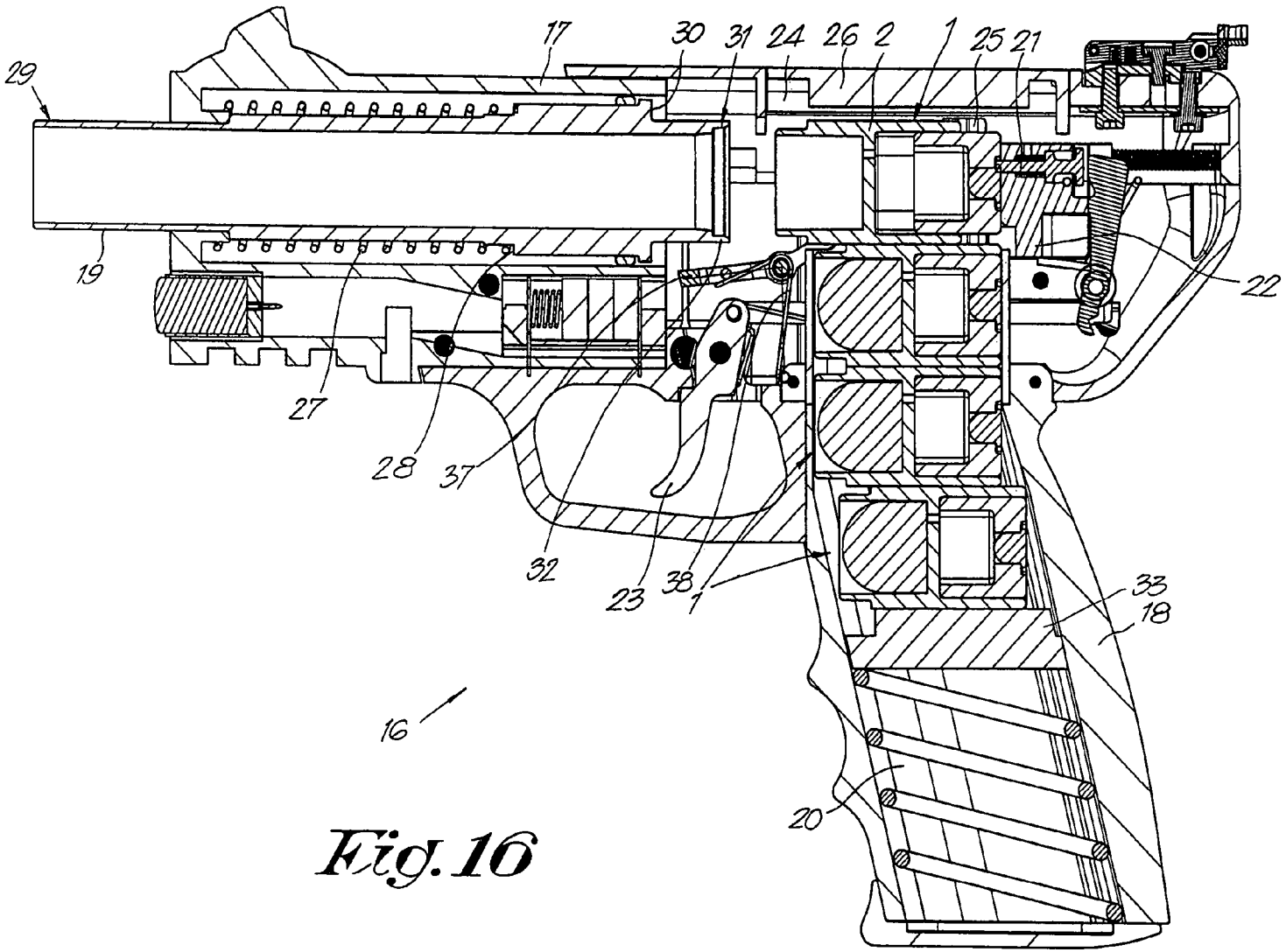
FIGS. 16 to 18 are sections similar to that in FIG. 10, but at successive moments after the firing.

After the exit of the projectile 6, the case 2 is checked in its movement by the stops 36, whereas the barrel continues its forward movement, compressing the release spring 27, as indicated in FIG. 16.

Figure 15:
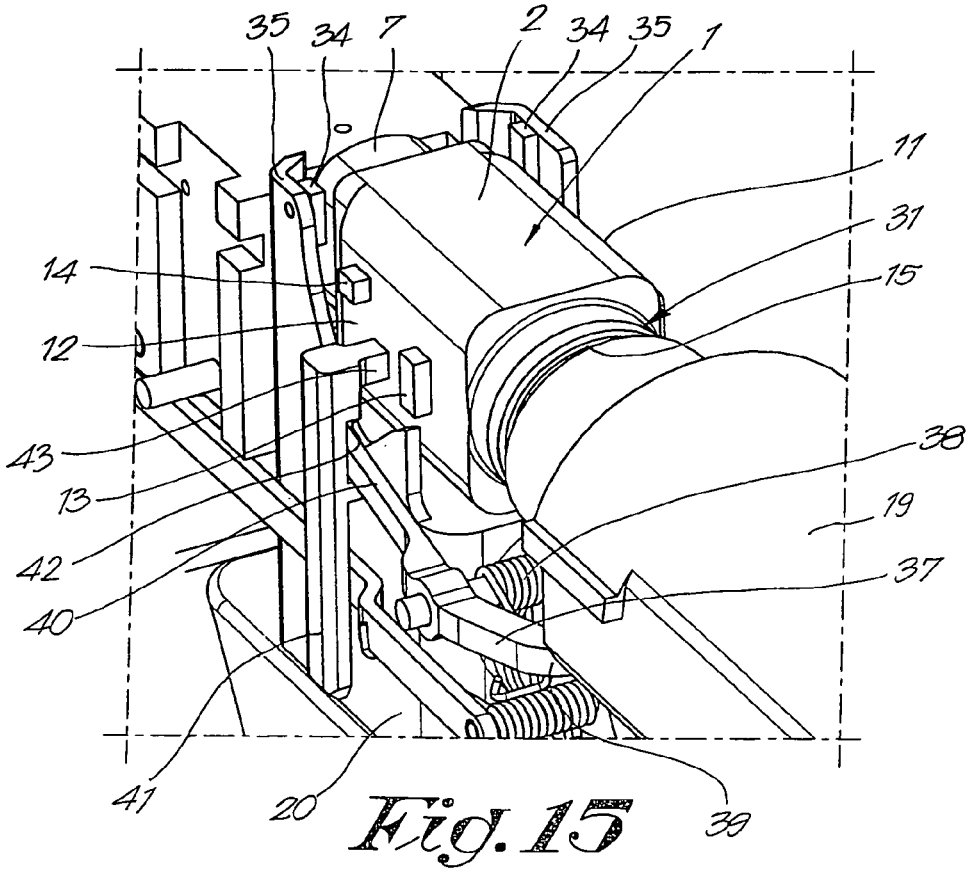
FIG. 15 is a view as that in FIG. 12, but for the situation of FIG. 14 when a shot is being fired.

As a result of the forward movement of the case 2, the peg 13 is released from the cam 43 of the push rod 41, as represented in FIG. 15, which as a result will no longer hold the tilting lever 37 which, as a consequence, will pivot through the action of the spring 38 until the front far end 39 touches the barrel.

Figure 17:
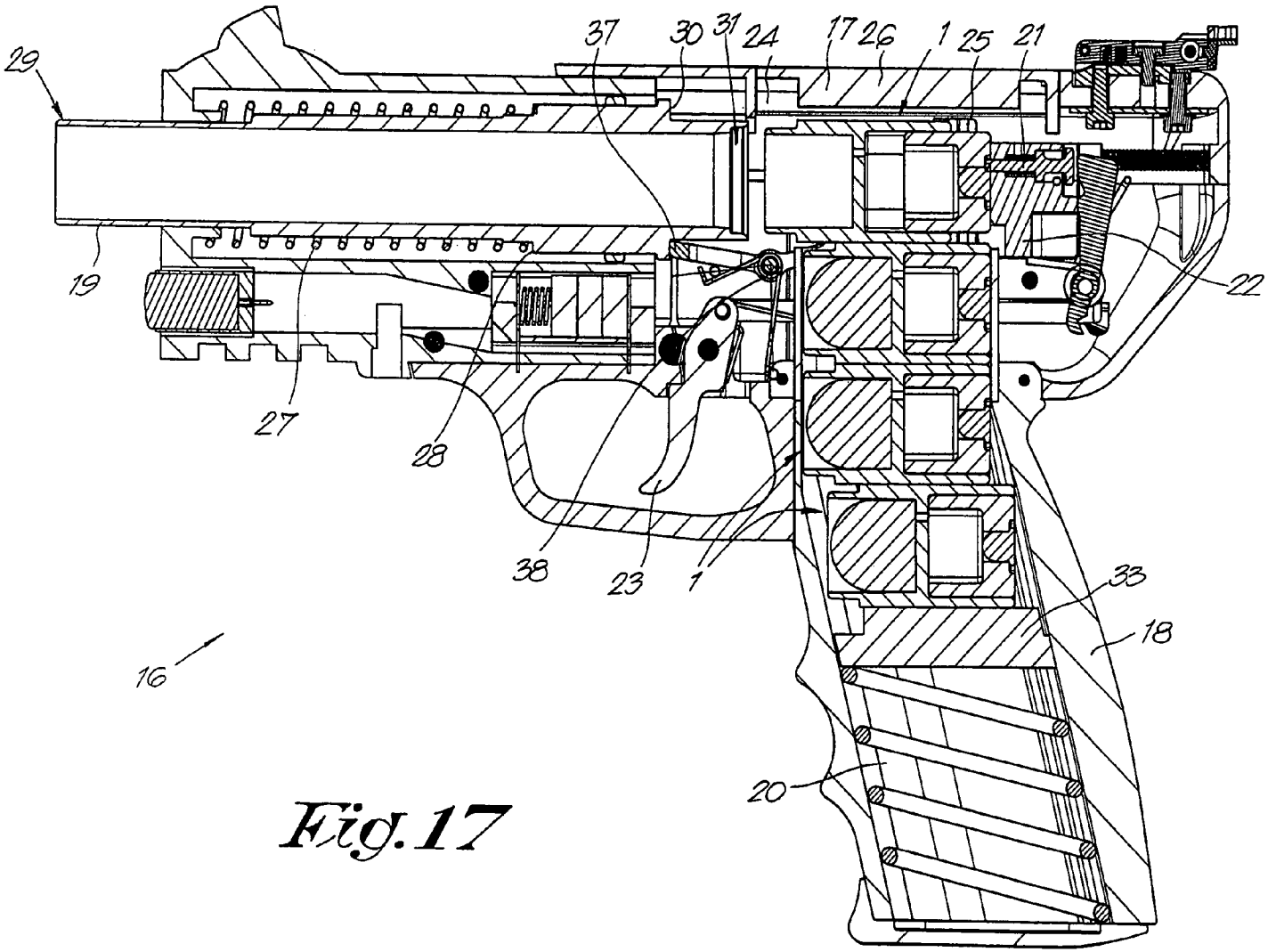

In this manner, the tilting lever 37 serves as a stop for the shoulder 30 when the barrel 19 draws back from its forward movement through the action of the spring 27 and stops the barrel 19 in a forward position as represented in FIG. 17 so as to allow for the ejection of the fired cartridge 1.

At the same time, the cam 43 drops behind the front pin 13 and prevents the case 2 from recoiling, while the piston 7 is deformed by the gas pressure, which makes it possible for the piston 7 to stay locked within the case 2 due to friction, and a stop is no longer required between the case 2 and the piston 7.

Figure 18:
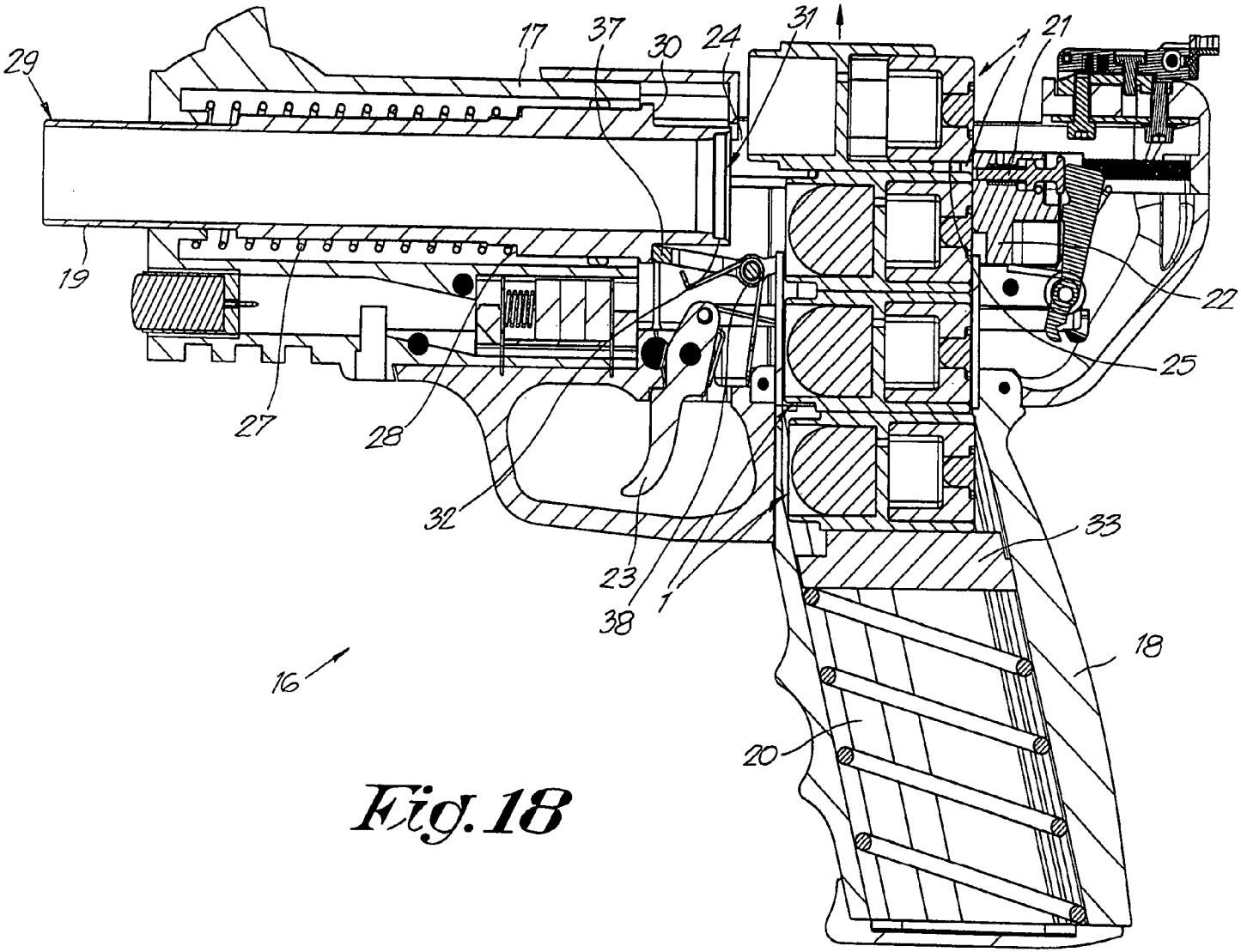
Figure 19:
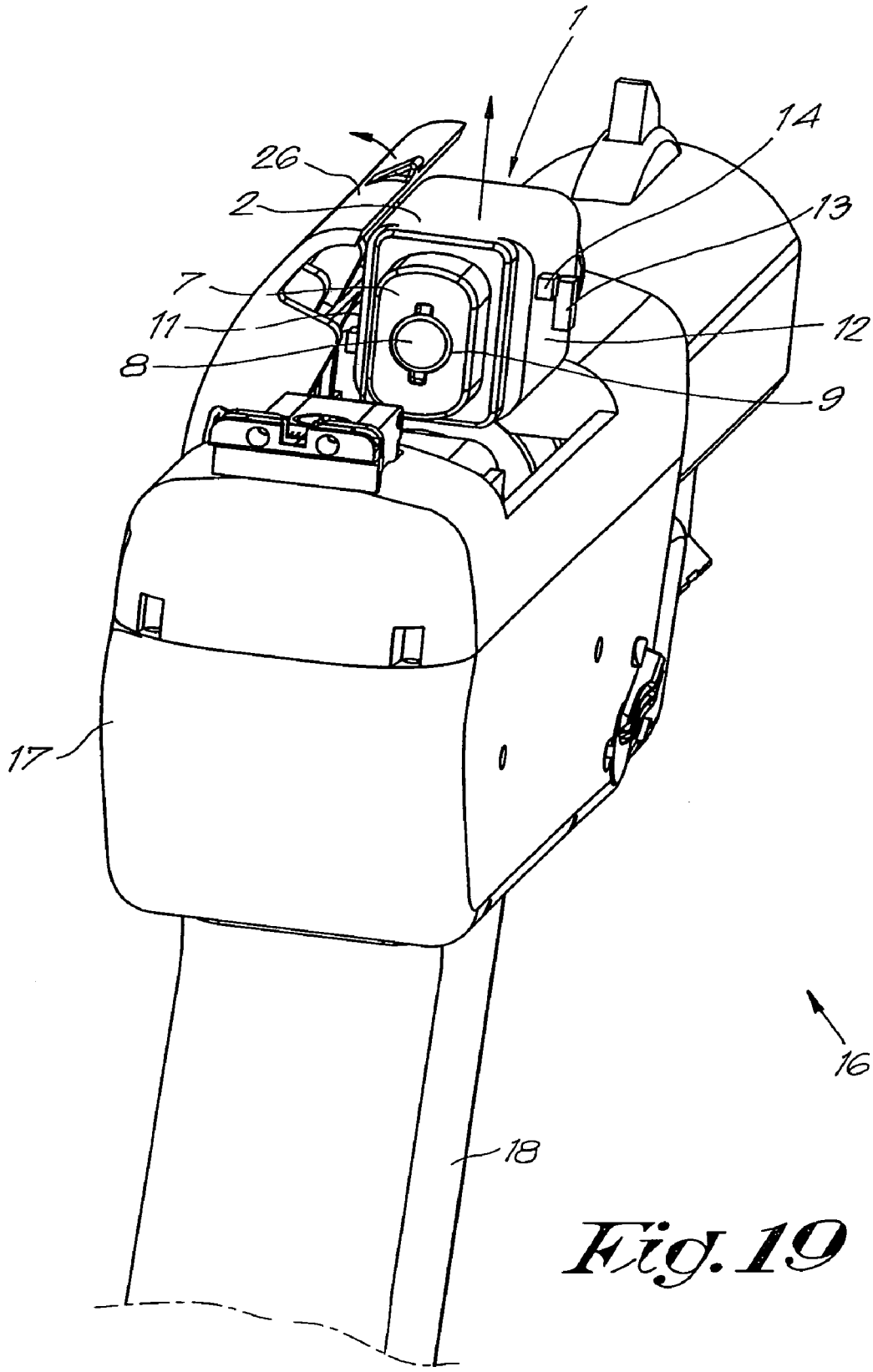
FIG. 19 is a view in perspective of the arm in FIG. 7, but during the ejection of a used cartridge.

As the empty cartridge 1 is no longer withheld by the stops 34, it is ejected through the ejection window 31 through the action of the feeder 33 of the loader 20 which pushes the following cartridges 1 towards the exit 21 of the loader 20, as represented in FIGS. 18 and 19.

The movement of the new cartridge 1 will again make the push rod 41 rise, which as a result will free the peg of the barrel 19 which can move back so as to push the new cartridge 1 against the supporting element 22 in order to obtain a new starting situation, ready to shoot again, as represented in FIG. 10.

It is clear that the invention is not merely restricted to firearms having an ammunition designed to launch a projectile with reduced lethality, but that it can also be applied to other types of ammunition.

Although the cases 2 and pistons 7 of the cartridge 1 are preferably made of plastic, it is not excluded to use other materials for their manufacture.

A firearm according to the invention can also be realized in the form of a gun, a grenade launcher or other types of arms.

The projectile 6 is preferably situated entirely in the low-pressure chamber 3 of the cartridge 1, but it can also at least partly extend past the front opening of the low-pressure chamber 3 of the cartridge 1.

Naturally, the peg of the barrel and the locking mechanism of said peg can also be realized in another manner than the one described above.

The tightness between a cartridge 1 and the barrel 19 can be realized in other ways than by fitting the front part 15 of the case 2 in the entry of the barrel 6.

It is clear that the invention is by no means limited to the above-described example, and that numerous modifications can be made to the above-described arm and ammunition while still remaining within the scope of the invention as defined in the following claims.

The invention claimed is:

1. Firing device comprising a firearm and its ammunition, said firearm comprising a casing, a barrel having an entry, a loader, a firing mechanism and the ammunition, said ammunition comprising one or several cartridges, each in the form of a case with a projectile and a propulsive charge, wherein the firearm further comprises means to carry a cartridge in the loader in front of the entry of the barrel and supported against a supporting element of the casing which comprises the firing mechanism, and wherein the barrel slides in the casing between at least a forward position for the positioning and ejection of a cartridge and a recoiled firing position in which the barrel comes to a stop through the action of a return spring against a front part of the case of the cartridge which is situated in front of the entry of the barrel, and further wherein each cartridge is provided with propulsion means to project, after having activated the firing mechanism, the case forward carrying along the barrel with the forward movement thereof, said case of the ammunition being provided with external protuberances enabling activation of a part of the mechanism of the firearm.

2. Device according to claim 1, wherein the firearm is provided with an abutment to restrict the forward movement of the case.

3. Device according to claim 2, wherein the case of the cartridges comprises two sides, one of which is provided with at least one pin, wherein said pin cooperates with the abutment to restrict the forward movement of the case.

4. Device according to claim 2, wherein the abutment to restrict the forward movement of the case is situated on the loader.

5. Device according to claim 1, wherein the propulsion means are formed of a piston which is situated in a high-pressure chamber provided in the rear part of the case, said piston slidable in the longitudinal sense of the case and being provided with a propulsive charge mounted in a longitudinal passage of the piston.

6. Device according to claim 5, wherein the propulsive charge is positioned such that the charge is situated in front of the firing mechanism when the cartridge is carried in front of the entry of the barrel.

7. Device according to claim 5, wherein the case of the cartridges comprises a cylindrical low-pressure chamber which is open on a front side thereof and which houses the projectile, said chamber being separated from the high-pressure chamber by a partition wall and communicating with the high-pressure chamber through at least one vent hole.

8. Device according to claim 7, wherein the diameter of the low-pressure chamber in which the projectile is situated is equal to or slightly smaller than the inner diameter of the barrel.

9. Device according to claim 8, wherein the entry of the barrel is provided with a concentric ring having an inner diameter which is equal to or slightly larger than the outer diameter of the front part of the case of a cartridge.

10. Device according to claim 9, wherein the ring of the barrel has a conical entry and the front part of the case is conical as well.

11. Device according to claim 5, wherein the case and the piston are made of plastic.

12. Device according to claim 1, wherein the cartridge is formed in such a manner that it can withstand the pressures in the cartridge resulting from the firing of the propulsive charge.

13. Device according to claim 1, wherein the means for carrying a cartridge in the loader in front of the entry of the barrel comprises a feeder in the loader which pushes the ammunition towards an exit of the loader and of an abutment at the exit of the loader.

14. Device according to claim 13, wherein the abutment at the exit of the loader is part of the loader.

15. Device according to claim 13, wherein the case of the cartridges comprises two sides, one of which is provided with at least one pin, said pin cooperating with the abutment at the exit of the loader.

16. Device according to claim 15, wherein the abutment at the exit of the loader and the pin cooperating with said abutment are configured such that the pin is released from the abutment when the case is projected forward by the projection means, in such a manner that the used cartridge can be ejected by means of the feeder in the loader.

17. Device according to claim 16, wherein the firearm is provided with an ejection window in the extension of the exit of the loader.

18. Device according to claim 17, wherein the ejection window is covered with a pivoting flap.

19. Device according to claim 1, wherein the firearm is provided with a catch for the barrel so as to lock the barrel in said forward position.

20. Device according to claim 19, wherein the catch for the barrel is provided with an unlocking mechanism controlled by the movement of a new cartridge which is placed in front of the entry of the barrel.

21. Device according to claim 19, wherein the catch for the barrel is configured in the form of a tilting lever which is provided with a return spring, a first far end of which cooperates with a shoulder of the barrel, and the second far end of which cooperates with the unlocking mechanism.

22. Device according to claim 21, wherein the unlocking mechanism comprises a push rod sliding in the direction of movement of a new cartridge when the latter is brought in front of the entry of the barrel, and which is provided with a groove in which the second far end of the catch for the barrel is situated, and which is provided with a cam which cooperates with a pin placed on a side of the case of the cartridge brought in front of the entry of the barrel.

* * * * *

UNITED STATES PATENT AND TRADEMARK OFFICE

CERTIFICATE OF CORRECTION

PATENT NO. : 7,617,758 B2
APPLICATION NO. : 11/254714
DATED : November 17, 2009
INVENTOR(S) : Gavage et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1062 days.

Signed and Sealed this

Fourteenth Day of December, 2010

David J. Kappos

David J. Kappos
*Director of the United States Patent and Trademark Office*